US005178073A

United States Patent [19]

Kotze et al.

[11] Patent Number: 5,178,073

[45] Date of Patent: Jan. 12, 1993

[54] OPEN TOP TIPPING RAIL VEHICLE WITH SIDE PROJECTION PROGRESSIVELY ENGAGING FORMATIONS AT DUMP SITE FOR ROTATING BODY 360 DEGREES AND DUMPING LOAD

[75] Inventors: Abraham P. L. Kotze; Gerrit J. J. Hulme, both of Transvaal, South Africa

[73] Assignee: Nalva Proprietory Limited, Bothaville, South Africa

[21] Appl. No.: 608,860

[22] Filed: Nov. 5, 1990

[30] Foreign Application Priority Data

Nov. 8, 1989 [ZA] South Africa ..... 89/8491
Jun. 18, 1990 [ZA] South Africa ..... 90/4697

[51] Int. Cl.[5] ..... B61D 9/14

[52] U.S. Cl. ..... 105/241.2; 104/18; 105/43; 105/261.1; 414/357

[58] Field of Search ..... 104/18, 29, 30; 105/4.1, 4.2, 4.3, 241.1, 241.2, 247, 261.1, 261.2, 264, 268, 270, 272; 414/357, 219; 222/166, 167, 368; 198/706

[56] References Cited

U.S. PATENT DOCUMENTS

| | | | |
|---|---|---|---|
| 804,412 | 11/1905 | Kelly | 105/216.2 |
| 2,043,134 | 6/1936 | Wannamaker | 105/4.3 X |
| 2,424,675 | 7/1947 | Wood | 222/368 |
| 2,700,482 | 1/1955 | Erickson | 105/272 X |
| 3,285,441 | 11/1966 | Keisey et al. | 105/270 X |
| 3,358,858 | 12/1967 | Zabel, Jr. | 105/272 X |
| 4,358,238 | 11/1982 | Ely | 105/241.2 X |
| 4,453,871 | 6/1984 | Lonnroth | 105/241.2 X |
| 4,750,606 | 6/1988 | Gough | 198/706 |

FOREIGN PATENT DOCUMENTS

| | | | |
|---|---|---|---|
| 532255 | 10/1956 | Canada . | |
| 89/8891 | 11/1989 | South Africa . | |
| 768703 | 11/1980 | U.S.S.R. | 105/214.2 |
| 1418137 | 8/1988 | U.S.S.R. | 105/216.2 |

*Primary Examiner*—Robert J. Oberleitner
*Assistant Examiner*—S. Joseph Morano
*Attorney, Agent, or Firm*—Young & Thompson

[57] ABSTRACT

This invention relates to a tipping rail vehicle including a wheeled frame and an open topped container body. It includes a connector pivotally connecting the body to the frame for rotation of the body at least partially about the pivot axis of the connector, with the pivot axis being normal to the intended direction of travel of the vehicle, and at least one formation on the container body for rotating the container body about the pivot axis to discharge material in the body from its open top. Preferably the container body is in the form of a substantially cylindrical drum with the pivot axis of the connector passing through parallel side walls of the body on or adjacent the axis of the cylinder with the body opening extending over the length of the cylindrical portion of the body between its side walls above the pivot axis of the connector. The invention additionally relates to a tipping arrangement for engagign and rotating the container body of the vehicle of the invention.

23 Claims, 5 Drawing Sheets

OPEN TOP TIPPING RAIL VEHICLE WITH SIDE PROJECTION PROGRESSIVELY ENGAGING FORMATIONS AT DUMP SITE FOR ROTATING BODY 360 DEGREES AND DUMPING LOAD

FIELD OF THE INVENTION

This invention relates to a tipping rail vehicle and more particularly to a tipping hopper for use in underground mines.

BACKGROUND TO THE INVENTION

Mine hoppers for underground use are well known. The most commonly used rail hoppers which are used to carry broken rock and reef in mines are of the bottom discharge type which include a rock container body which has an open bottom which is closed when the vehicle is loaded by one or more generally clam shaped doors. Other hopper types exist which have container body floors which are sloped to one side of the hopper and a body wall enclosure portion which is located on the floor and which at an ore pass tip is lifted with one edge of the floor or from the floor to side discharge material in the body from between the floor and the lower edge of the side wall portion of the container body.

Yet further hopper types have the floor of the container body pivotally connected at one end to the lower portion of an end wall of the body so that the body floor drops away for tipping from the opposite end wall at a tip while the wheels at that end of the hopper are supported by some lifting arrangement. In a similar hopper version the body is in one way or another tipped about a pivot arrangement on the hoper chassis to discharge material carried by the hopper through a door in one of its ends.

A problem common to hoppers of the above type which have low level doors is that broken rock and reef is loaded into the hoppers together with a fair amount of water and sludge which carries mineral fines. The sludge gravitates through rock in the hopper bodies to leak from between the doors and side walls of the hopper container bodies and into the rail ballast between the hopper rails at the hopper loading site and as the hoppers are pulled to a tip. Even though some hopper doors carry seals these become ineffective after only a small amount of use.

Not only is it a highly labor intensive, tedious and therefore expensive business continually to clean the sludge from the environs, but also a significant amount of mineral fines which are carried by the sludge is washed to waste or remains forever trapped in the rail ballast. This is a particularly serious problem in gold mining.

Yet a further problem with all known discharge rail hoppers which are discharged while they are being drawn over a tip for bottom discharge or by lifting, is that they are discharged by a tipping action in a direction transverse to the direction of hopper travel through the tip. The tipping loads thus imposed on the hoppers in this manner are high with a number of hopper types including stops or rollers which engage and run along fixed structure during tipping to prevent the hoppers from being tipped from the rails which carry them. The high tipping forces imposed on these hoppers during tipping generate higher than necessary draw loads on the locomotive pulling the hopper train throuh the tip.

Another mining problem that arises with the use of automatic discharge hoppers which are bottom discharged or tipped while moving, is that the tip excavation at the mouths to the ore passes are of necessity large and in the region of 9 to 12 meters in length making them difficult and expensive to construct while also creating large hazardous footwall areas.

Still a further problem with all tipping rail vehicles known to the applicant is the obvious loss of carrying capacity and so mine production where the vehicles are run on an incline. This is frequently a problem in mining operations in which the inclines on which the hoppers or rail vehicle skips operate are as much as 25° to the horizontal.

OBJECT OF THE INVENTION

It is the object of this invention to provide a tipping rail vehicle with which the above problems mentioned in connection with known mine hoppers are eliminated or at the very least minimized.

SUMMARY OF THE INVENTION

A tipping rail vehicle according to the invention includes a wheeled frame, an open topped container body, means pivotally connecting the body to the frame for rotation of the body at least partially about the pivot axis of the connecting means with the pivot axis being normal to the intended direction of travel of the vehicle, and at least one formation on the body for rotating the container body about the pivot axis to discharge material in the body from its open top. Preferably the container body is water impervious.

Preferably the container body is in the form of a substantially cylindrical drum with the pivot axis of the connecting means passing through parallel side walls of the body on or adjacent the axis of the cylinder with the body opening extending over the length of the cylindrical portion of the body between its side walls above the pivot axis of the connecting means.

Further according to the invention the wheeled frame includes on at least one of its ends, in the intended direction of travel of the vehicle, an arcuate plate which extends from the lip of the body opening to a lower position on the underside of the frame with its radius of curvature centered approximately on the body pivot axis with the plate being positioned on the frame relative to the container body to minimize spillage from the lip of the container body opening as the container body is rotated about its pivot axis towards inversion. Preferably, to facilitate tipping of the container body in both directions of travel of the rail vehicle, the vehicle includes one of the above arcuate plates at each end of the frame in the direction of vehicle travel, with the lower ends of the plates being spaced from each other across the underside of the container body to define between them a discharge zone through which material in the container body is discharged as the container body is rotated to inversion.

Conveniently the vehicle includes at each end of the frame in the direction of vehicle travel, an end frame assembly which includes a pair of rail wheels, one of the arcuate plates, two vertical side plates which are parallel to and on the outside of the container body side walls and to which the arcuate plates are fixed, and a coupling arrangement for coupling the vehicle to identical adjacent vehicles in a train.

The vehicle frame includes side frame members which are parallel to and on the outside of container body side walls and means releasibly attaching the side frame members to the end frame assemblies.

The conecting means may include a pivot pin which is fixed to and projects outwardly from each of the end walls of the container body and the side frame members include bearings in which the pivot pins are rotatable.

In one form of the invention the coupling arrangement on one end frame assembly includes an upwardly inclined plate which projects horizontally from the frame of the vehicle in the intended direction of travel of the vehicle, and on the other end frame a horizontally outwardly projecting plate which is downwardly inclined with the outer edge of the downwardly inclined plate being vertically lower than the outer edge of the upwardly inclined plate, so that when the under surface of the upwardly inclined coupling plate of one vehicle is engaged with and runs onto the upper surface of the downwardly inclined coupling plate of another vehicle, the end of the vehicle which carries the upwardly inclined plate is lifted vertically to clear the wheels on the end frame which carries the upwardly inclined plate from the rails with which they were engaged. Also included is a latching arrangement for locking the two coupling plates together when so engaged.

The latching arrangement preferably includes a pin which is fixed to and projects in a substantially vertical direction from one of the coupling plates, a slot in the other coupling plate in which the pin is engaged when the coupling plates of the vehicles are engaged, and a releasable catch for holding the pin on the one plate in the slot in the other plate of the other vehicle.

Still further according to the invention, each tipping formation on the container body is a formation which projects outwardly from a wall of the container body in a direction normal to the intended direction of travel of the vehicle to engage, in use, one or more catches at a tip to cause the container body to rotate at least partially about the pivot axis of the connecting means as the vehicle is being moved over a tip, so as to tip the contents of the container body into the tip.

Preferably the container body includes a plurality of tipping formations which are arranged in a suitably spaced relationship on the container body about the connecting means pivot axis and which, in use, progressively engage, as the vehicle is moved over the tip, a plurality of catches at the tip which are suitably spaced in the direction of vehicle travel to cause rotation of the container body about its pivot.

Conveniently the vehicle includes a releasable catch for locking the container body to the frame against rotation relative to the frame in a selected position of rotation of the body relative to the frame prior to the vehicle entering a tip.

A tipping arrangement for tipping a rail vehicle as described above according to the invention includes an elongated structure which is located at the side of a tip parallel to a rail track which passes over the tip, and a plurality of catches which are fixed to and project from the tipping arrangement structure towards the rail track in a suitably spaced relationship in the direction of vehicle travel over the tip for progressively engaging the tipping formations on the container body of the rail vehicle as the container body to be rotated by the catches.

Preferably the tipping arrangement includes a trip arrangement which is attached to and projects from the tip arrangement structure at at least one end of the structure, for engaging and releasing the container body locking catch to free the container body for rotation relative to the frame as the vehicle enters the tip.

The tipping arrangement structure is conveniently pivotally located at the side of a tip for movement between a first position, in which its catches project towards the rail track to engage the tipping formations on the rail vehicle, and a second position in which the catches are clear of the path of the tipping formations on the vehicle.

The tipping arrangement may include a pair of doors for opening and closing the tip opening and means attached between the tipping arrangement structure and the doors for opening the doors when the structure is in its first position and for closing the doors when the structure is in its second position.

DETAILED DESCRIPTION OF THE DRAWINGS

Figure 1:
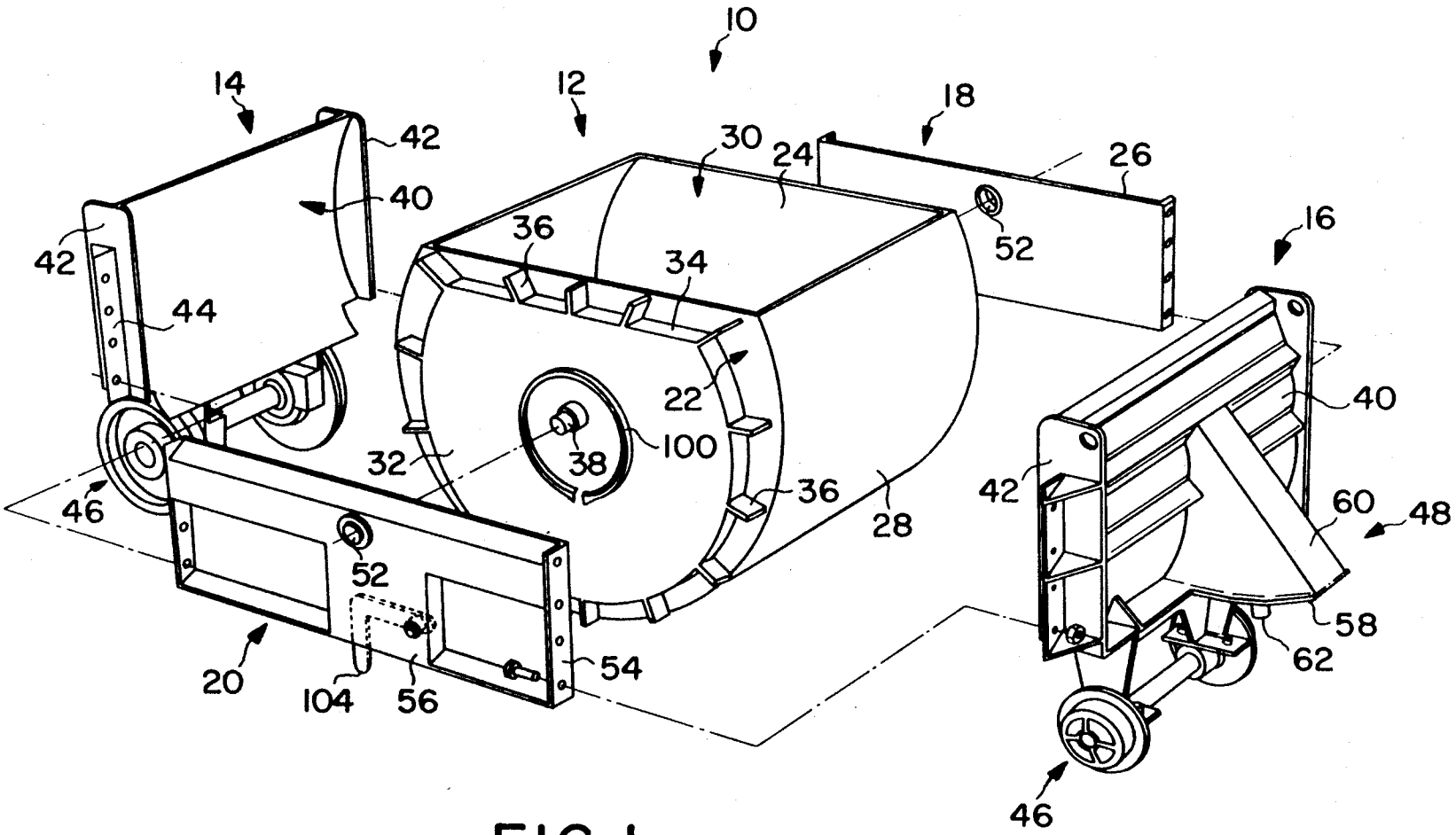
Figure 2:
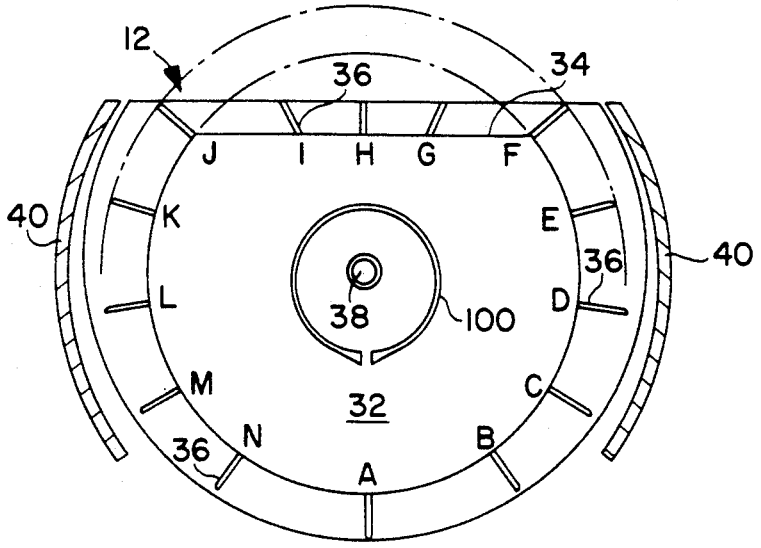
Figure 3:
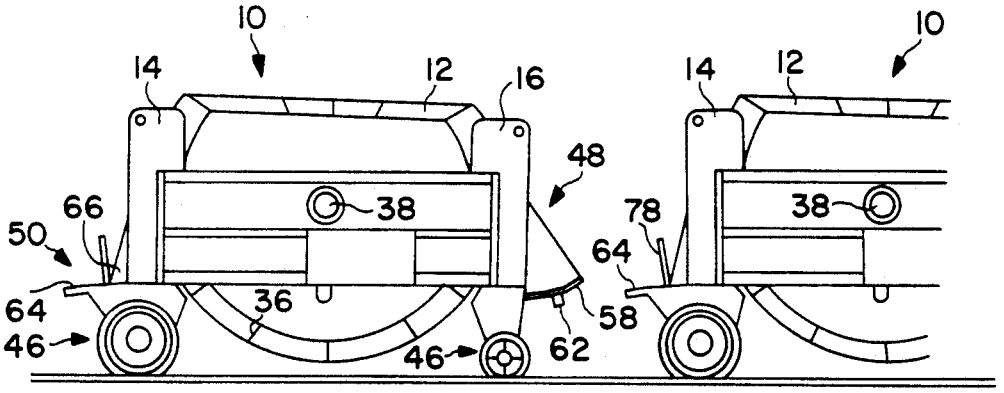
Figure 4:
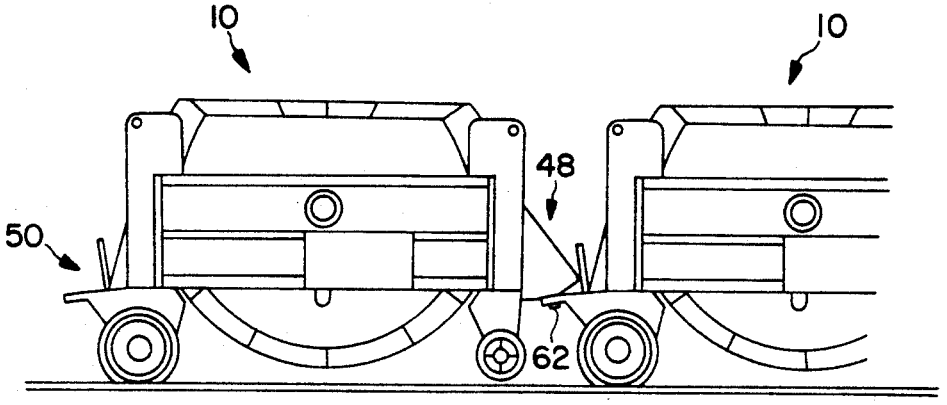
Figure 5:
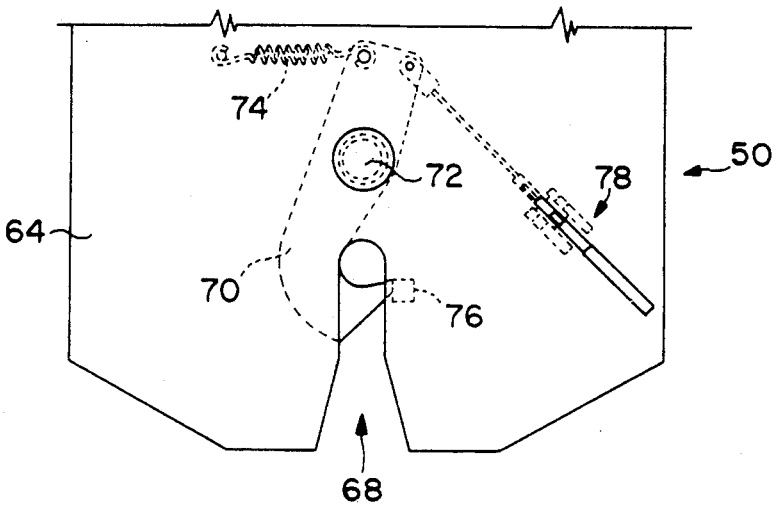
Figure 6:
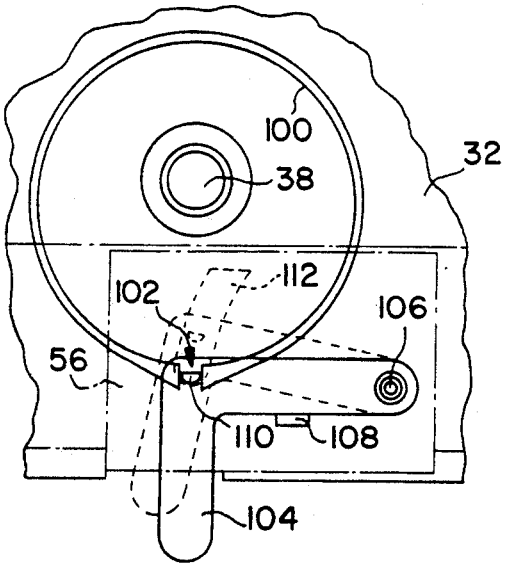
Figure 7:
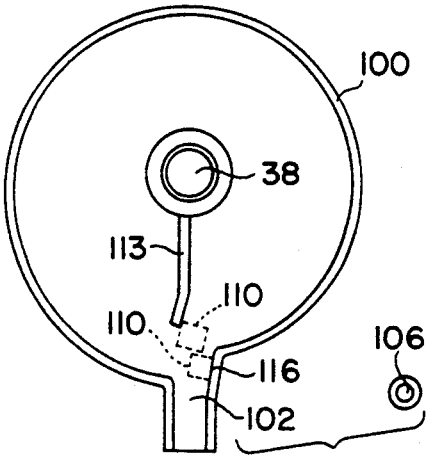
Figure 8:
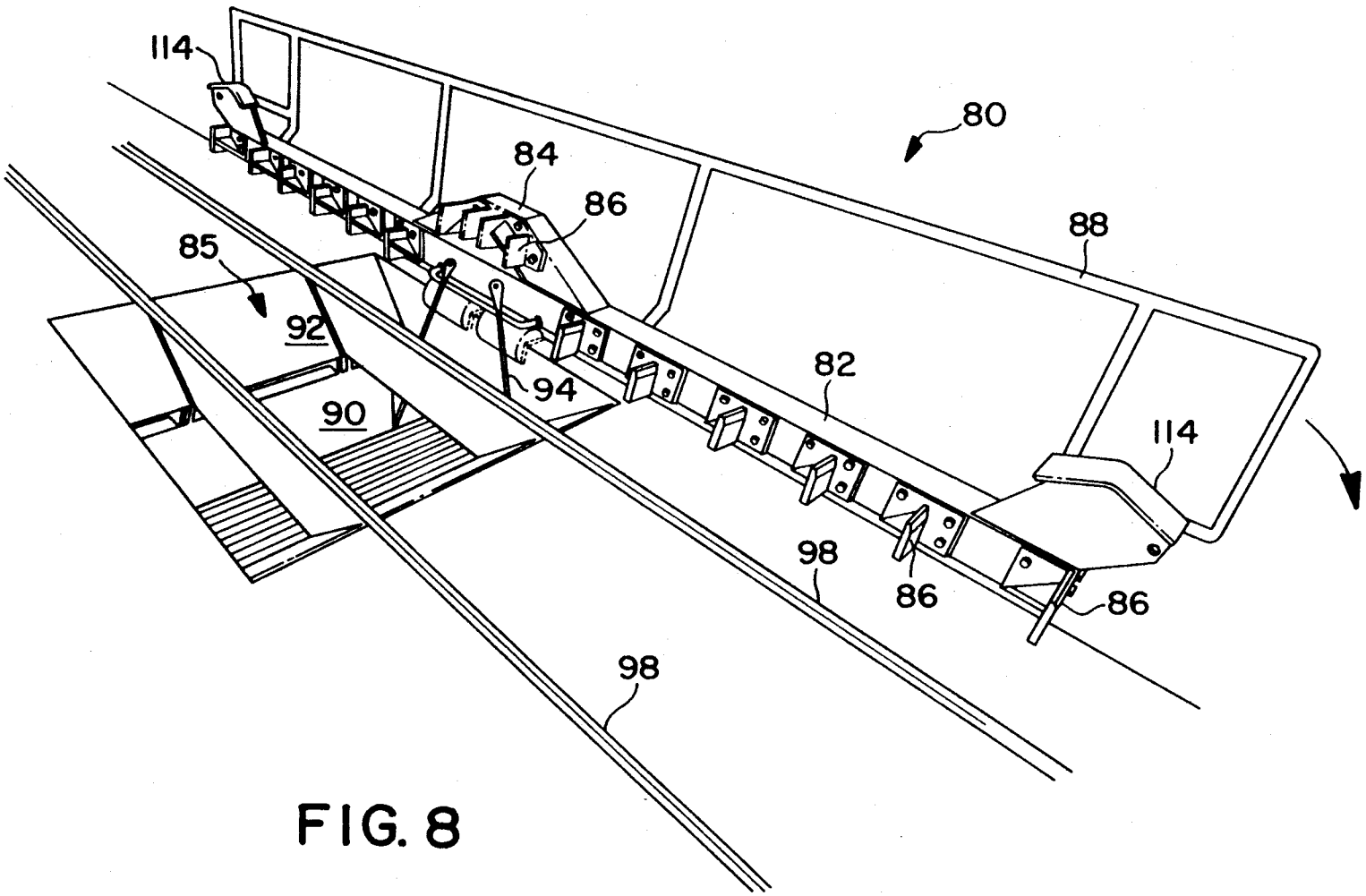
Figure 9:
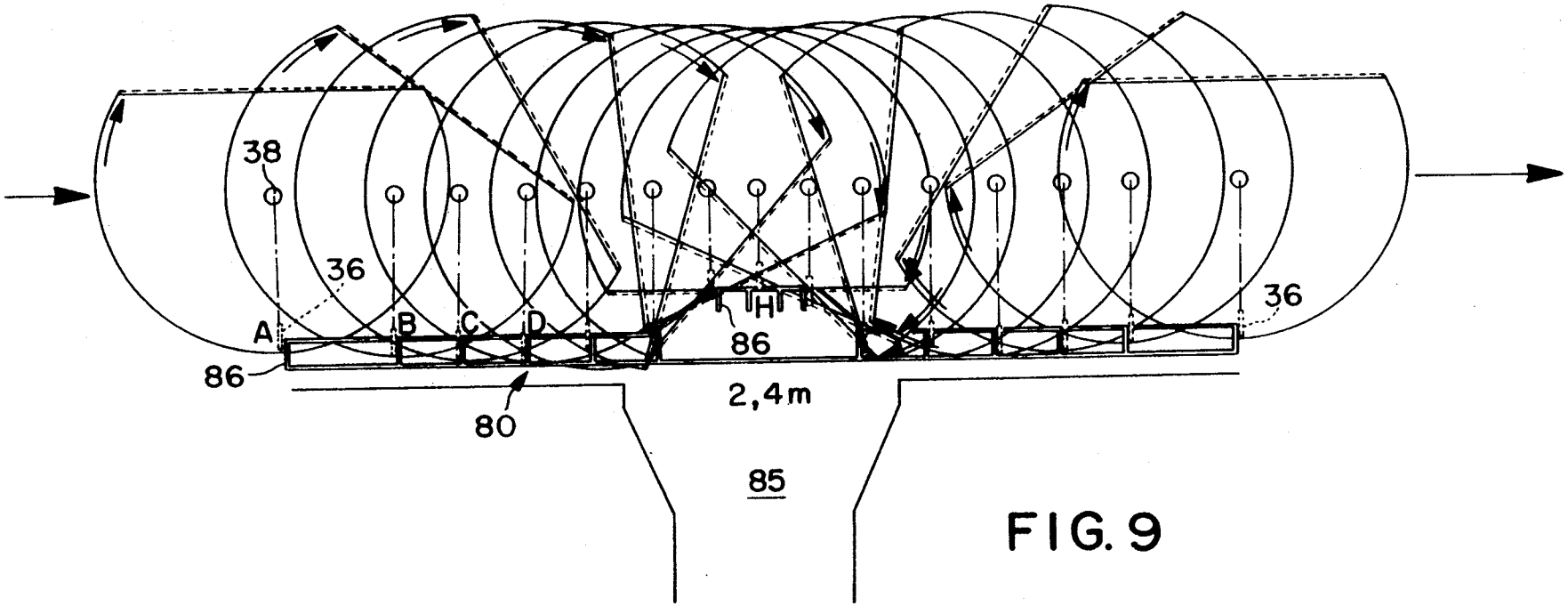

An embodiment of the invention is now described by way of example only with reference to the drawings in which:

FIG. 1 is an exploded perspective view of the rail vehicle of the invention which, in this embodiment, is an underground mine hopper, FIG. 2 is a side elevation of the container body of the hopper of FIG. 1, FIG. 3 is a partially schematic side elevation of two of the hoppers of the invention shown uncoupled, FIG. 4 is a view similar to that of FIG. 3 showing the two vehicles coupled, FIG. 5 is a fragmentary plan view of the coupling arrangement at one end of the hopper, FIG. 6 is a partially ghosted side elevation of one embodiment of a catch for locking the container body of the FIG. 1 hopper to the hopper frame, FIG. 7 is a schematic side elevation of a second embodiment of the FIG. 6 catch, FIG. 8 is a perspective view of a tipping arrangement located adjacent a tip for use with the hopper of FIG. 1, and FIG. 9 is a schematic front elevation illustrating the tipping sequence of the container body of the FIG. 1 hopper while being rotated by the FIG. 8 tipping arrangement at a tip.

DETAILED DESCRIPTION OF THE PREFERRED EMBODIMENT

As mentioned above, the tipping rail vehicle of the invention is, in this embodiment, a mine hopper 10 which includes an open topped container body 12, end frame assemblies 14 and 16 and side frame members 18 and 20.

The hopper container body 12 is in the form of a cylindrical drum with its parallel side walls 22 and 24 having, in side elevation, the shape of a major segment of a circle which is centered on a pivot axis 26. The end walls of the body are joined by a substantially cylindrical wall 28 with the only opening into the body 12 being through its open top 30 so that the body 12 is leakproof.

The sidewall 22 of the body carries an outwardly projecting boss 32 which, save for its flat upper end 34, is perfectly circular on the pivot axis 26 of the body. The sides of the boss 32 and the side wall 22 carry radially projecting teeth 36, the outer ends of each of which, on the circular portion of the boss, also lie on a circle centered on the axis 26 as is more clearly seen in FIG. 2. The boss 32 as well as the side wall 24 each carry an outwardly projecting pivot pin 38 which is co-axial with the pivot axis 26 of the hopper body. The pivot pins may be the ends of a continuous axle which passes through the cavity of the container body 12.

The container body 12 illustrated in FIG. 1 is shown to have a boss 32 on only its endwall 22 but it is to be appreciated that an identical boss and tooth arrangement could be provided on the side wall 24 to enable the hopper to be located on the track on which it is to be used in either direction. Additionally, some hoppers in a train could be provided with the toothed boss arrrangement on one side wall and others on the other side wall so that one of the hopper types could be discharged only at a waste tip while those with the bosses 32 on the opposite side walls could be filled with ore only to be tipped into an ore pass reserved for ore only. This may easily be achieved merely by swapping the positions of the end frame assemblies of a hopper.

The end frame assemblies 14 and 16 each include arcuate plates 40, two side plates 42 to which the side edges of the arcuate plates are fixed, suitably buttressed coupling brackets 44 on each side plate 42 which each carry four vertically spaced bolt holes and wheel assemblies 46. The wheel assembly on the end frame assembly 14 is a substantially conventional hopper wheel assembly which is attached to the end frame assembly through a suitable suspension arrangement. The wheel assembly on the end frame 16 is a simple assembly which may, but in this embodiment of the hopper does not, include any form of suspension. The end frame assembly 16 carries a coupling arrangement 48 and the assembly 14 a coupling arrangement 50, which is not shown in FIG. 1 but will be described below with reference to FIGS. 3 and 5.

The curvature of the arcuate plates 40 of the end frame assemblies, when the hopper is assembled, is such that the inner surfaces of the plates are spaced only slightly from the lip of the container body opening 30 as the container body 12 is rotated between them in use to minimize spillage from the body opening 30 until the lip of the opening clears the lower edge of the plates. In the assembled hopper the side plates 42 are located adjacent the end walls of the body to minimize spillage in a lateral direction during tipping of the body.

The side frame members 18 and 20 each carry a bearing arrangement 52 in which the pivot pins 38 on the container body are journalled for rotation. The vertical ends of the frame members include bolting flanges 54 which each carry a series of four vertically spaced bolt holes the spacing of which corresponds to the bolt holes in the brackets 44 on the end frame assemblies. The side frame member 20 additionally includes a catch arrangement 56 the purpose of which will be explained below.

To assemble the hopper, the bearings 52 on the side frame members 18 and 20 are located over the pivot pins 38 of the container body 12. The end frame assemblies 14 and 16 are then simply bolted to the side frame members by means of high tensile steel bolts which are passed through the registering holes in the brackets 44 on the end frame assemblies and the flanges 54 on the side frame members. From this it will be appreciated that the entire assembly and dis-assembly of the hopper is simple and can be speedily accomplished by even unskilled personnel. This rapid assembly and dis-assembly capability of the hopper of the invention greatly facilitates the transportation of the hoppers into and out of a mine in a conventional shaft cage. With a hopper of the invention having a carrying capacity of 3.4 cubic meters the diameter of the container body is 1.62 meters and the total assembled length of the hopper from the end of one coupling arrangement to the other is only 2.995 meters, while conventional rail hoppers of the same carrying capacity have a length of about 3.4 meters without their coupling buffers and need their buffers to the disconnected for the hoppers to fit into and be transported by a mine cage. The relatively short length of the hopper of the invention also results in a significantly shorter train than would be necessary with conventional hoppers of the same carrying capacity.

The coupling arrangement 48 on the end frame assembly 16 of the hopper includes, as is seen in FIGS. 1 and 3, an outwardly projecting plate 58 which is upwardly inclined, a stiffening buttress formation 60 which is fixed to the outside of the arcuate plate 40 and the plate 58, and a downwardly depending coupling 62. The coupling arrangement 50 on the end frame assembly 14 includes a downwardly directed plate 64 which is shown in FIG. 3 and also in FIG. 5 and a buttress formation 66 which is similar to the buttress 60 on the end frame assembly 16 and which is fixed to the outside of the arcuate plate 40. As shown in FIG. 5, the downwardly directed plate 64 of the coupling arrangement 50 includes a slot 68, a catch 70 which is pivotally connected by a pivot pin 72 to the plate 64, a spring 74 for biasing the catch against a stop 76 on the underside of the plate 64, and a release handle 78 which is connected to the catch against the bias of the spring 74 for releasing the catch to uncouple two coupled hoppers.

As is seen from the hopper on the left in FIG. 3, the vertical distance between the track flange on the wheels of the wheel assembly on the end frame assembly 16 and the underside of the side frame member 20 is less than that of the wheels on the assembly 14 so that the frame of the hopper, when uncoupled from another hopper, is slightly downwardly inclined towards the end frame assembly 16. The relative angles of the coupling plates 58 and 64 of the hopper coupling arrangements are such that, when the hoppers are uncoupled as shown in FIG. 3, the forward edge of the plate 58 is slightly higher than the rear edge of the plate 64 of a second hopper. To couple the hoppers, the hopper on the left in FIG. 3 is moved towards the hopper on the right until the underside of the plate 58 engages and rides up on the plate 64 of the hopper to which it is to be coupled with the pin 62 entering the slot 68 in the plate 64 until it displaces the catch to the left in FIG. 5 to abut against the base of the slot 68. When the coupling pin has passed the nose of the catch 70 the catch is biased back into the position shown in FIG. 5 by the spring 74 to trap the coupling pin 62 in the slot 68 to couple the two vehicles together. As the plate 58 is driven up onto the plate 64 of another hopper, buffing energy is expended in lifting the end frame assembly 16 and the wheels of its wheel assembly 46 clear of the rails as is shown in FIG. 4. The coupled hoppers of a train so coupled have only the wheels of the end frame assemblies 14 engaged with the rails and this together with the fact that the coupling pivot is located rearwardly of the axles of the wheel assembly 46 on the end frame assemblies 14, enable the hoppers in a train to be self steering so enabling the hoppers to be employed on sharper curves without the fear of derailment which would not be the case with conventional hoppers of the same carrying capacity which have all four of their wheels engaged with the railtrack. This self steering capability of the hoppers results in less rail and wheel wear than is common with conventional hoppers.

To uncouple the hoppers in a train, the handle 78 is operated manually, without fear of the operator's hands becoming crushed between components of the two hoppers, to release the catch 70 from the coupling pin 62 of coupled hoppers with the two hoppers then merely being manually pushed away from each other to enable the hopper including the coupling pin to ride down the plate 64 of the coupling arrangement 50 of the other vehicle until its wheels on the end frame assembly 16 again engage the rails on which the hopper train is located.

The hopper tipping arrangement 80 for use with the hopper of FIG. 1 is illustrated in FIG. 8 and is shown to include an elongated beam 82 which has a raised central portion 84 which is situated opposite the center of a tip 85 in use. The forward face of the beam 82 carries catch formations 86 which project perpendicularly from the beam 82 on both the linear portion of the beam 82 as well as on the upper portion of the raised central portion 84 of the beam towards trackrails 98 which pass over the tip 85. The number and spacing of the formations 86 is such as progressively to engage the teeth 36 on a hopper approaching the tip to rotate the container body 12 of the hopper as the hopper is pulled through the tip.

The tipping arrangement 80 additionally includes a hand rail 88 and pivot lugs, not shown, on the rearface of the beam 82 which pivotally connects the beam 82 to fixed structure at the back of the beam 82 so that the tip may be moved from the vertical position shown in the drawing in which the catches 86 lie in the path of the teeth 36 of a hopper while passing over the tip, and a second position in the direction of the arrow in the drawing in which the hand rail 88 is horizontal and the catches 86 are clear of the path of the teeth 36 on a hopper passing over the tip. The tipping arrangement 80 additionally includes a frame structure which is located over the mouth of the tip which includes two doors 90, only one of which is seen in the drawing, which are pivotally connected at their outer edges to the lower edges of downwardly inclined guide plates 92, so that the doors are both movable between a horizontal position in which they close the tip opening to minimize the possibility of personnel and objects falling into the tip while the tip is not in operation, and a vertical position shown in the drawing in which they serve as guides for material which is dumped into the tip. The doors 90 are both connected by means of heavy cables 94 to the beam 82 of the tipping arrangement as shown in the drawing. Each cable is engaged over a rotatable roller which is mounted at the side of the tip opening, so that when the tipping arrangement 80 is in its raised and operative position as shown in the drawing, the doors are open, and when the tipping arrangement is moved to its second position, out of the path of the hopper teeth 36, the cables 94 are tensioned to close the doors 90 and so close the tip opening.

In use, when a hopper 10 or a train of hoppers 10 approaches a tip with the tipping arrangement 80 in the upright position as shown in FIG. 8, the tooth 36 marked A in FIG. 2 on the container body 12 of the hopper engages the first catch formation 86 on the tipping arrangement 80 to cause the container body to commence to rotate in a clockwise direction as illustrated by the arrows in FIG. 9. With continued rotation of the body, the tooth A eventually clears the first catch formation 86, and as it does so, the tooth B engages the second catch to continue rotation of the body in a clockwise direction as the hopper is pulled through the tip. This process is repeated with subsequent teeth engaging the catches on the tipping arrangement 80. The rotation of the container body continues with the teeth 36 of the hopper abutting up against and being moved by the faces on the left of the catch formations 86 in FIG. 9, until the teeth, G, H and I on the portion 34 of the hopper container body boss 32 engage the catches on the raised portion 84 of the tipping arrangement beam 82. In this zone of rotation of the body, the body commences falling under gravity to the right in the drawing and the hopper teeth from H to N now engage the righthand faces of the catches 86 to prevent uncontrolled rotation of the hopper body.

The turning movement arm on the hopper of the invention, as will be appreciated from FIG. 2, is as long as it can be between the axis 26 and the teeth 36 so minimizing the draw load imposed on whatever is pulling the hopper or train of hoppers through the tip. The draw load on the hopper or train is further reduced by the gravity induced rotation of the container bodies when they have been rotated over-center at the tip.

It is to be noticed from FIG. 9, that the entire contents of the hopper body are tipped from between the lower edges of the arcuate plates 40 on the end frame assemblies 14 and 16 only while the hopper is inverted or nearly so only immediately above the tip opening. With a hopper of the dimensions mentioned above, the entire tipping action takes place in just a little over 1 meter of hopper travel while immediately above the tip opening. This feature of the hopper of the invention allows for tip openings of under 3 meters in length, as opposed to the 9 to 12 meter lengths necessary for the tipping of conventional hoppers which are discharges while moving through a tip.

The lower transverse edges of the plates 40 prevent the contents of the container body from coming into contact with the axles of the wheel assemblies 46 during tipping, so minimizing damage to and unnecessary wear of these components.

Oscillation of the hopper container body 12 about its pivot axis 26 while being loaded and while the hoppers are being pulled to the tip from the loading side, is prevented by the catches 56 mentioned with reference to FIG. 1. The catch arrangement 56 is more clearly illustrated in FIG. 6 to include an approximately circular catch ramp ring 100 which is fixed to the sidewall of the container body boss 32 eccentrically about the pivot 38 as is shown in FIGS. 1 and 6. The ring 100 has a gap 102 which is situated in the ring vertically below the axis of the pivot pin 38. The catch additionally includes a catch arm 104 which is located in and pivotally attached at 106 to a box housing on the side frame member 20. The anti-clockwise rotation of the catch arm 104 from the position shown in FIG. 6 is prevented by a stop 108 in the box housing in which the catch is located. The catch arm 104 carries a catch formation 110 which projects through an arcuate slot 112 on the inner face of the catch arm box housing to very nearly abut the outer surface of the container body boss 32. With the catch arm 104 in the solid line position in FIG. 6, the catch formation 110 engages the vertical edges of the gap 102 in the ring 100 to prevent rotation of the container body relative to the hopper frame and is held in this position under gravity. The lower end of the catch arm projects from the underside of the box housing in which the arm is located to be located beneath the lower edge of the side frame member 20 as illustrated in FIGS. 1 and 6. As the container body 12 is held under gravity in the position shown in FIGS. 1 and 2, accidental unlatching of the catch arrangement 56 does not cause the generally disastrous result which arises from the accidental unlatching of most conventional hopper doors.

The tipping arrangement 80, as shown in FIG. 8, includes at each of its ends, an elevated ramp formation 114 which engages and rotates the catch arm 104 of the catch arrangement 56 from the solid line position in FIG. 6 to the dotted line position in which the catch 110 is lifted into the ring 100 clear of the side walls of the gap 102 to enable the hopper body to be rotated. The purpose of the eccentric mounting of the ring 100 is so that the catch formation 110 will be engaged by the inner wall of the ring as the hopper body is rotated for the short radius upper portion of the ring in the drawing, so as to support the catch and hold the catch arm 104 in its retracted position well clear of the catch formations 86 on the raised portion 84 of the tipping arrangement beam 82 while the container body is inverted and the contents of the hopper are being discharged into the tip. As the hopper body passes the raised portion 84 of the tipping arrangement, the catch formation 110 again rides down onto the long radius portion of the ring 100 to again drop into the gap 102 to again lock the container body against rotation relatively to the hopper frame. As mentioned above and as shown in FIG. 8, a ramp formation 114 is located at both ends of the tipping arrangement, which means that the catch formation 110 will be lifted from the inner wall of the ring 100 by the ramp 114 as the hopper leaves the tip area and will merely be dropped into the gap 102 under gravity as the catch arm 104 is released by the exit ramp 114. This second lifting of the catch arm 104 will of course not occur with tipping arrangements through which the hoppers are moved in only one direction and which will therefore require only one lifting ramp 114. To minimize the possibility of the catch formation 110 overshooting the gap 102 when the hoppers are pulled at fairly high speed through a tip, the ring 100 may be spiralled as shown in FIG. 7 and include a stop arm 113, with the free end of the arm 113 and a face member 116 serving as stops for the catch formation above the gap 102 in the ring 100 irrespective of the direction of rotation of the hopper body relative to the hopper frame. On hoppers which are intended only for operation on inclined tracks, the gap 102 in the rings 100 would not be positioned vertically below the pivot axis of the hopper body as illustrated in the drawings, but would be arcuately displaced from the pivot axis normal radial by an angle corresponding to the angle of the incline on which the hopper is to operate, so that the container body may be locked against rotation to the inclined hopper frame with the open top 30 of the hopper horizontal, thereby maximizing the carrying capacity of the container body 12 while operating on the incline.

The invention is not limited to the precise details as herein described. For example the hopper container body need not necessarily be cylindrical and could have any suitable shape provided the teeth 36 or whatever tipping mechanism is used on the body located on a circle centered on the pivot pin 38. Additionally, if a hopper of the invention is to serve as an incline skip, independently of other hoppers, the wheel assembly 46 of the end frame assembly 16 could be replaced by a wheel assembly 46 such as that which includes a suspension system on the end frame assembly 14. The invention is also not limited to the use only of the teeth 36 as a means for rotating the container body, and these could, for example, be replaced by outwardly directed pegs or rollers which could engage suitable catch formations on the tipping arrangement 80 to tip the container body in the same fashion as described above.

We claim:

1. A tipping rail vehicle comprising a wheeled frame, a container body having an open top, means pivotally mounting the body on the frame for complete rotation of the body 360° in one direction of rotation about a horizontal pivot axis normal to the direction of travel of the vehicle, and means on the body to rotate the body 360° in said one direction of rotation to discharge material in the body from said open top, said container body being in the form of a substantially cylindrical drum having parallel side walls through which said pivot axis passes, and said container body having a center of gravity located at a point lower than said pivot axis.

2. A rail vehicle as claimed in claim 1, in which said container body is water impervious.

3. A rail vehicle as claimed in claim 1, and an arcuate plate on said frame at the end of said frame which is forward of said container body in the intended direction of movement of the vehicle, said arcuate plate having a curvature centered on said axis and being so disposed as to minimize spillage from the container body as the container body is rotated about said axis.

4. A rail vehicle as claimed in claim 3, there being a said arcuate plate at each end of the frame, said plates having lower ends spaced from each other to define between them a discharge opening through which material from the container body is discharged upon inversion of the container body.

5. A rail vehicle as claimed in claim 4, there being two vertical side plates that are parallel to and on the outside of said container body side walls, said side plates being fixed to said frame and to said arcuate plates, and means for coupling the vehicle to identical adjacent vehicles in a train.

6. A rail vehicle as claimed in claim 5, and means releasably securing said side plates to the frame.

7. A rail vehicle as claimed in claim 1, including a coupling arrangement at each end of the frame in the direction of vehicle travel, the coupling arrangement at one end of the frame including a plate which projects outwardly and upwardly from the frame in the direction of vehicle travel, an outwardly projecting and downwardly inclined plate at the opposite end of the vehicle in the direction of vehicle travel, so that when a lower surface of the upwardly inclined coupling plate of one vehicle is engaged with and runs onto an upper surface of the downwardly inclined coupling plate of an adjacent vehicle, the end of the vehicle which carries the upwardly inclined plate is lifted vertically to raise wheels on the end of the frame which carries the upwardly inclined plate from rails on which the wheels formerly rested, and latching means for locking said plates together when so engaged.

8. A rail vehicle as claimed in claim 7, wherein said latching means includes a pin which is fixed to and projects substantially vertically from one of said plates, there being a slot in the other said plate in which said pin engages when said plates are engaged with each other, and a releasable catch for holding said pin in said slot.

9. A rail vehicle as claimed in claim 1, wherein said means for rotating the container body about said axis comprises a formation which projects outwardly from a wall of the container body in a direction normal to the intended direction of travel of the vehicle and which engages at least one catch at a tip to cause the container body to rotate 360° in said direction of rotation as the vehicle moves over said tip to discharge the contents of the container body into said tip.

10. A rail vehicle as claimed in claim 9, wherein said container body includes a plurality of said formations which are arranged in a suitably spaced relationship on the container body about said axis and which in use progressively engage a plurality of said catches at said tip, said catches being suitably spaced in said direction of vehicle travel to cause rotation of the container body about said pivot axis.

11. A rail vehicle as claimed in claim 1, further comprising a releasable catch for locking the container body to the frame against rotation relative to the frame in a predetermined position of rotation of the body relative to the frame.

12. A tipping arrangement for tipping a rail vehicle as claimed in claim 1, comprising an elongated structure which is located at the side of a tip parallel to a rail track which passes over the tip and on which said rail vehicle rides, a plurality of catches which are fixed to and project from said elongated structure in a direction toward said track in a suitably spaced relationship in the direction of vehicle travel over the tip and that progressively engage tipping formations on the container body of the rail vehicle as the vehicle moves over the tip thereby to cause rotation of the container body 360° in said direction of rotation.

13. A tipping arrangement as claimed in claim 12, including a trip arrangement which is attached to and projects from said tipping arrangement at at least one end of said elongated structure for engaging and releasing catch means to free the container body for rotation relative to the frame as the vehicle enters the tip.

14. A tipping arrangement as claimed in claim 12, also including structure pivotally mounted at the side of said tip for movement between a first position in which catches on said structure project toward the rail track to engage tipping formations on the rail vehicle, and a second position in which said catches are clear of the path of said tipping formations on the vehicle.

15. A tipping arrangement as claimed in claim 14, including a pair of doors for opening and closing an opening to said tip that receives material from said container body when said container body is inverted, and means for opening the doors when said pivotally mounted structure is in said first position and for closing said doors when said pivotally mounted structure is in said second position.

16. A tipping rail vehicle including a wheeled frame, an open topped container body, means pivotally connecting the body to the frame for rotation of the body at least partially about the pivot axis of the connecting means with the pivot axis being normal to the intended direction of travel of the vehicle and so positioned on the container body that the open top of the container body will remain horizontal on the body irrespective of the angle of inclination of the rail track on which the vehicle is to operate, and a plurality of tipping formations arranged in a suitably spaced relationship on the container body for rotating the container body about the connecting means pivot axis, so that, in use, said tipping formations progressively engage, as the vehicle is moved over the tip, a plurality of catches at the tip which are suitably spaced in the direction of vehicle travel to cause rotation of the container body about its pivot, said container body being in the form of a substantially cylindrical drum with the pivot axis of the connecting means passing through parallel side walls of the body on or adjacent the axis of the cylinder with the body opening extending over the length of the cylindrical portion of the body between its side walls above the pivot axis of the connecting means, said wheeled frame including on at least one of its ends, an arcuate plate positioned on the frame relative to the container body to minimize spillage from the container body as the container body is rotated about its pivot axis towards inversion.

17. A rail vehicle as claimed in claim 16 in which the container body is water impervious.

18. A rail vehicle as claimed in claim 16, wherein the arcuate plate is positioned at the end of the wheeled frame in the intended direction of travel of the vehicle, and said arcuate plate extends from a lip of the body opening to a lower position on the underside of the frame with its radius of curvature centered approximately on the body pivot axis.

19. A rail vehicle as claimed in claim 16 including a said arcuate plate at each end of the frame in the direction of vehicle travel with the lower ends of the plates being space from each other to define between them a discharge zone through which material in the container body is discharged as the container body is rotated to inversion.

20. A rail vehicle as claimed in claim 19 including at each end of the frame in the direction of vehicle travel an end frame assembly which includes a pair of rail wheels, one of the arcuate plates, two vertical side plates which are parallel to and on the outside of the container body side walls and to which the arcuate plates are fixed and a coupling arrangement for coupling the vehicle to identical adjacent vehicles in a train.

21. A rail vehicle as claimed in claim 20 in which the frame includes side frame members which are parallel to and on the outside of container body side walls and means releasibly attaching the side frame members to the end frame assemblies.

22. A rail vehicle as claimed in claim 21 in which the connecting means includes a pivot pin which is fixed to and projects outwardly from each of the side walls of the container body and the side frame members include bearings in which the pivot pins are rotatable.

23. A rail vehicle as claimed in claim 16 including a releasable catch for locking the container body to the frame against rotation relatively to the frame in a selected position of rotation of the body relatively to the frame.

* * * * *